US011805839B2

(12) United States Patent
Lu

(10) Patent No.: US 11,805,839 B2
(45) Date of Patent: Nov. 7, 2023

(54) HEADWEAR WITH A PROTECTIVE SHIELD

(71) Applicant: Chien-Hung Lu, Tainan (TW)

(72) Inventor: Chien-Hung Lu, Tainan (TW)

( * ) Notice: Subject to any disclaimer, the term of this patent is extended or adjusted under 35 U.S.C. 154(b) by 44 days.

(21) Appl. No.: 17/585,578

(22) Filed: Jan. 27, 2022

(65) Prior Publication Data

US 2023/0232931 A1 Jul. 27, 2023

(51) Int. Cl.
*A42B 3/22* (2006.01)
*A42B 1/0184* (2021.01)

(52) U.S. Cl.
CPC ..... *A42B 3/222* (2013.01); *A42B 1/0184* (2021.01)

(58) Field of Classification Search
CPC .. A42B 3/20; A42B 3/22; A42B 3/222; A42B 3/223; A42B 3/225; A42B 1/247; A61F 9/06; A61B 90/05; G02C 3/02; A41D 13/1184
See application file for complete search history.

(56) References Cited

U.S. PATENT DOCUMENTS 1,601,830 A * 10/1926 Huntsman ..... A61F 9/06 2/8.2
2,396,239 A * 3/1946 Beck ..... A61F 9/06 2/8.1
2,410,256 A * 10/1946 Anderson ..... A61F 9/061 D29/110
2,440,596 A * 4/1948 Anderson ..... A61F 9/06 2/8.1
2,588,553 A * 3/1952 McWethy ..... A61F 9/06 2/8.1
2,649,019 A * 8/1953 Hartline ..... A42B 3/04 2/8.1
3,075,201 A * 1/1963 Lindblom ..... A61F 9/06 2/8.1
3,685,054 A * 8/1972 Raschke ..... A42B 3/225 2/10
4,193,132 A * 3/1980 Peterson ..... A61F 9/06 2/8.1
4,222,123 A * 9/1980 Hellberg ..... A42B 3/225 2/10
4,224,694 A * 9/1980 Palmaer ..... A42B 3/166 2/8.1
4,442,551 A * 4/1984 Hellberg ..... A42B 3/04 2/10
4,464,800 A * 8/1984 Edwards ..... A61F 9/06 2/451
4,479,738 A * 10/1984 Kubnick ..... A61F 9/06 2/10

(Continued)

FOREIGN PATENT DOCUMENTS

EP 0668029 A1 * 2/1995

*Primary Examiner* — Heather Mangine

(57) ABSTRACT

A headwear includes a hat having two connection portions formed to two opposite sides of the hat. Two connectors are respectively connected to the two connection portions of the hat by two respective first end parts thereof. Two first arms are respectively and pivotably connected between two respective second end parts of the two connectors and a protective shield. Two second arms are respectively and pivotably connected between two respective second end parts of the two connectors and the protective shield. The first and second arms form a link mechanism to smoothly pivot the protective shield between its operation position and its folded position relative to the hat.

6 Claims, 11 Drawing Sheets

(56) References Cited

U.S. PATENT DOCUMENTS 5,012,528 A * 5/1991 Pernicka ..... A42B 3/225 2/10
5,337,419 A * 8/1994 Russell ..... A61F 9/02 128/857
5,966,738 A * 10/1999 Wang Lee ..... A42B 3/04 2/10
6,041,435 A * 3/2000 Paulson ..... A42B 3/225 2/10
6,892,393 B1 * 5/2005 Provost ..... G02C 3/02 2/10
8,214,920 B1 * 7/2012 Edgar ..... A42B 3/04 2/8.2
2004/0181856 A1 * 9/2004 Oleson ..... A42B 3/04 2/10
2004/0199982 A1 * 10/2004 Wang-Lee ..... A42B 3/225 2/10
2006/0080761 A1 * 4/2006 Huh ..... A61F 9/06 2/10
2007/0283801 A1 * 12/2007 Gallo ..... B32B 5/22 428/323
2009/0313745 A1 * 12/2009 Kang ..... A42B 3/225 2/424
2010/0223707 A1 * 9/2010 Moyses ..... A42B 3/225 2/8.2
2012/0246807 A1 * 10/2012 Klotz ..... A42B 3/225 2/243.1
2013/0031693 A1 * 2/2013 Gleason ..... A42B 3/225 2/9
2013/0212787 A1 * 8/2013 Pfanner ..... A42B 3/225 2/424
2015/0264992 A1 * 9/2015 Happel ..... A42B 3/04 2/422
2015/0335093 A1 * 11/2015 Curci ..... A42B 3/225 2/424
2016/0331059 A1 * 11/2016 Basson ..... A42B 3/222
2016/0360820 A1 * 12/2016 Sommers ..... A42B 3/225
2017/0255027 A1 * 9/2017 Hofer-Kraner ..... A61F 9/067
2020/0292831 A1 * 9/2020 Jenkins ..... G02B 27/0176
2020/0383417 A1 * 12/2020 Bohn ..... A42B 3/225
2021/0244125 A1 * 8/2021 Williams ..... A42B 3/223
2021/0307448 A1 * 10/2021 Sanders ..... A42B 3/225
2021/0321711 A1 * 10/2021 Fiorino ..... A42B 3/222
2021/0345721 A1 * 11/2021 Hoppe ..... A42B 3/225
2021/0378328 A1 * 12/2021 Vieira ..... A41D 13/1184
2022/0071334 A1 * 3/2022 Huang ..... A42B 3/222
2022/0346487 A1 * 11/2022 Whitesell ..... A42B 3/225
2022/0361620 A1 * 11/2022 Lu ..... A42B 3/221

* cited by examiner

HEADWEAR WITH A PROTECTIVE SHIELD

BACKGROUND OF THE INVENTION

1. Fields of the Invention

The present invention relates to a headwear, and more particularly, to a hat with a protective shield which is pivotably connected to the hat to protect the user's eyes.

2. Descriptions of Related Art

Some hats has a protective shield which is a transparent shield and cab be positioned in front of the user's eyes so as to protect the user's eyes and face from being hurt by foreign objects.

In order to allow the protective shield to be pivoted relative to the hat, Taiwanese Utility Model No. M617580 discloses a pivotable structure which is used to a soft hat and includes a curve rod and a straight rod. The shortcoming is that the protective shield has to be pushed hard when the protective shield is pivoted about the straight rod. Besides, there will be a gap formed between the protective shield and the hat when the protective shield is not in use.

Taiwanese Patent No. 1740798 discloses another pivotable structure that improves the shortcoming of the above mentioned structure, and uses two curved links. In order to smoothly pivot the protective shield, the structure includes a first rail, a second rail, a guide wall, a curve slot and a path. The structure becomes complicated and the manufacturing cost is increased.

The present invention intends to provide a headwear that includes a hat with a protective shield to eliminate the shortcomings mentioned above.

SUMMARY OF THE INVENTION

The present invention relates to a headwear and comprises a hat having two connection portions formed to two opposite sides of the hat. Two connectors each have a first end part and a second end part respectively formed to two ends of the connector. The two respective first end parts of the two connectors are respectively connected to the two connection portions of the hat. Two first arms each have a first section and a second section which is angularly formed to the first section. The two respective first sections are respectively and pivotably connected to the two respective second end parts of the two connectors. The two respective second sections are respectively and pivotably connected to a protective shield. Two second arms each have a third section and a fifth section which is angularly formed to the third section. The two respective third sections are respectively and pivotably connected to the two respective second end parts of the two connectors. The two respective fourth sections are respectively and pivotably connected to the protective shield.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
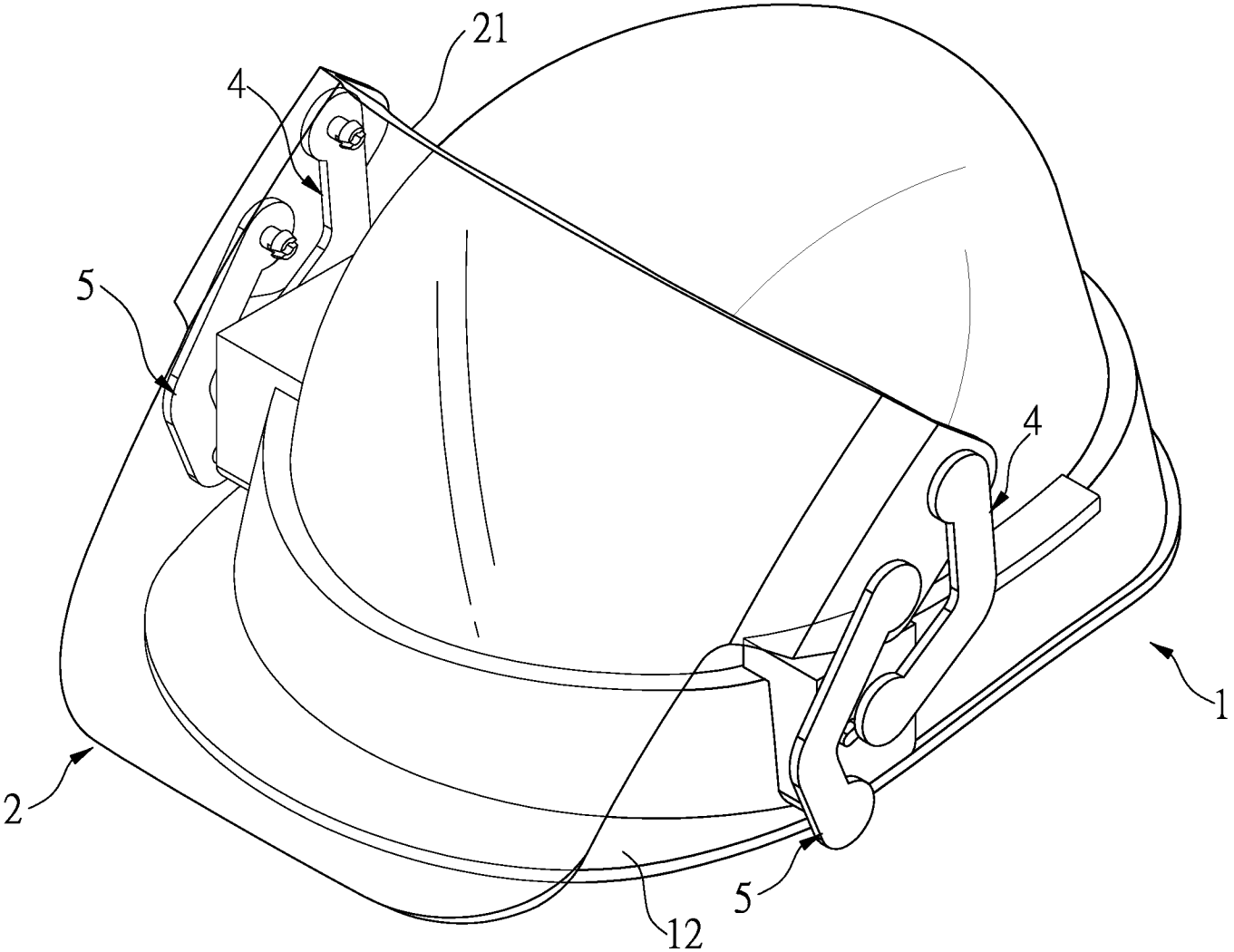
FIG. 1 is a perspective view to show the headwear of the present invention.
Figure 2:
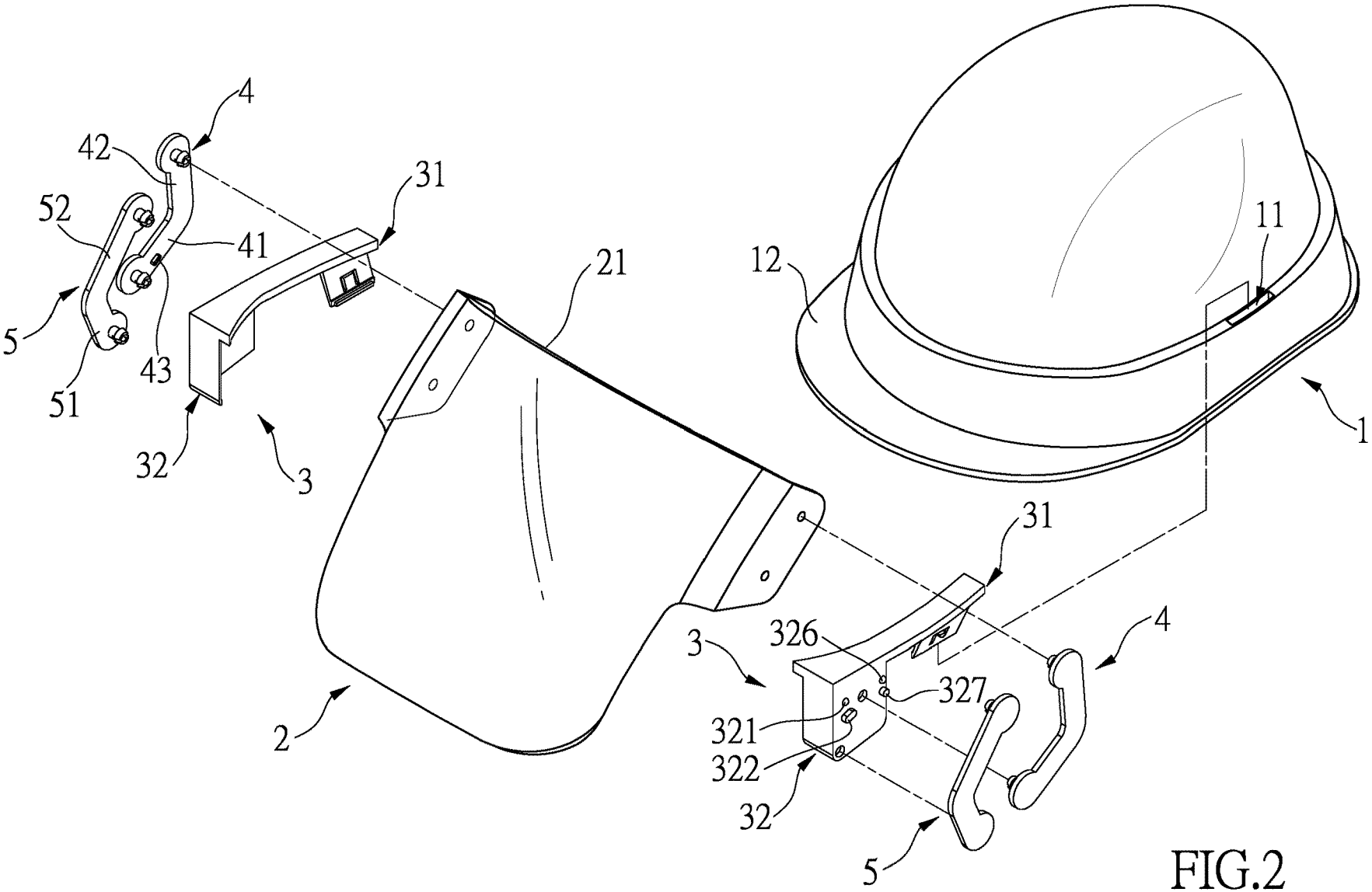
FIG. 2 is an exploded view of the headwear of the present invention.

Referring to FIGS. 1 and 2, the headwear of the present invention comprises a hat 1 having a visor 12 extending from a front of the hat 1, and two connection portions 11 are formed to two opposite sides of the hat 1. The hat 1 can be a topless or with a top. Two connectors 3 each have a first end part 31 and a second end part 32 respectively formed to two ends of the connector 3. The two respective first end parts 31 of the two connectors 3 are respectively connected to the two connection portions 11 of the hat 1.

Two first arms 4 each have a first section 41 and a second section 42 which is angularly formed to the first section 41. The two respective first sections 41 are respectively and pivotably connected to the two respective second end parts 32 of the two connectors 3. The two respective second sections 42 are respectively and pivotably connected to a protective shield 2.

Two second arms 5 each have a third section 51 and a fifth section 52 which is angularly formed to the third section 51. The two respective third sections 51 are respectively and pivotably connected to the two respective second end parts 32 of the two connectors 3. The two respective fourth sections 52 are respectively and pivotably connected to the protective shield 2.

Figure 3:
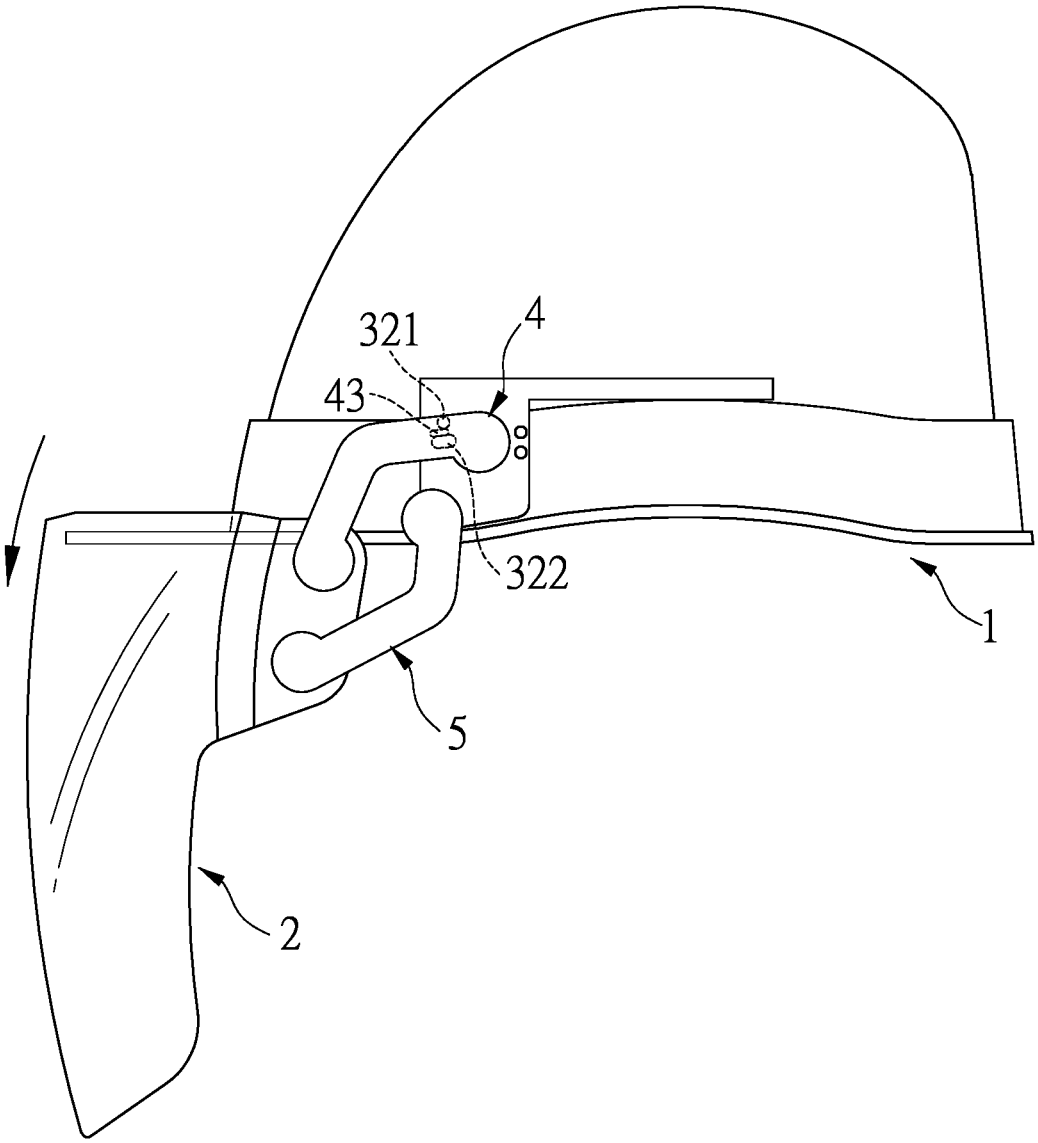
FIG. 3 shows that the protective shield is pivoted to its operation position.
Figure 4:
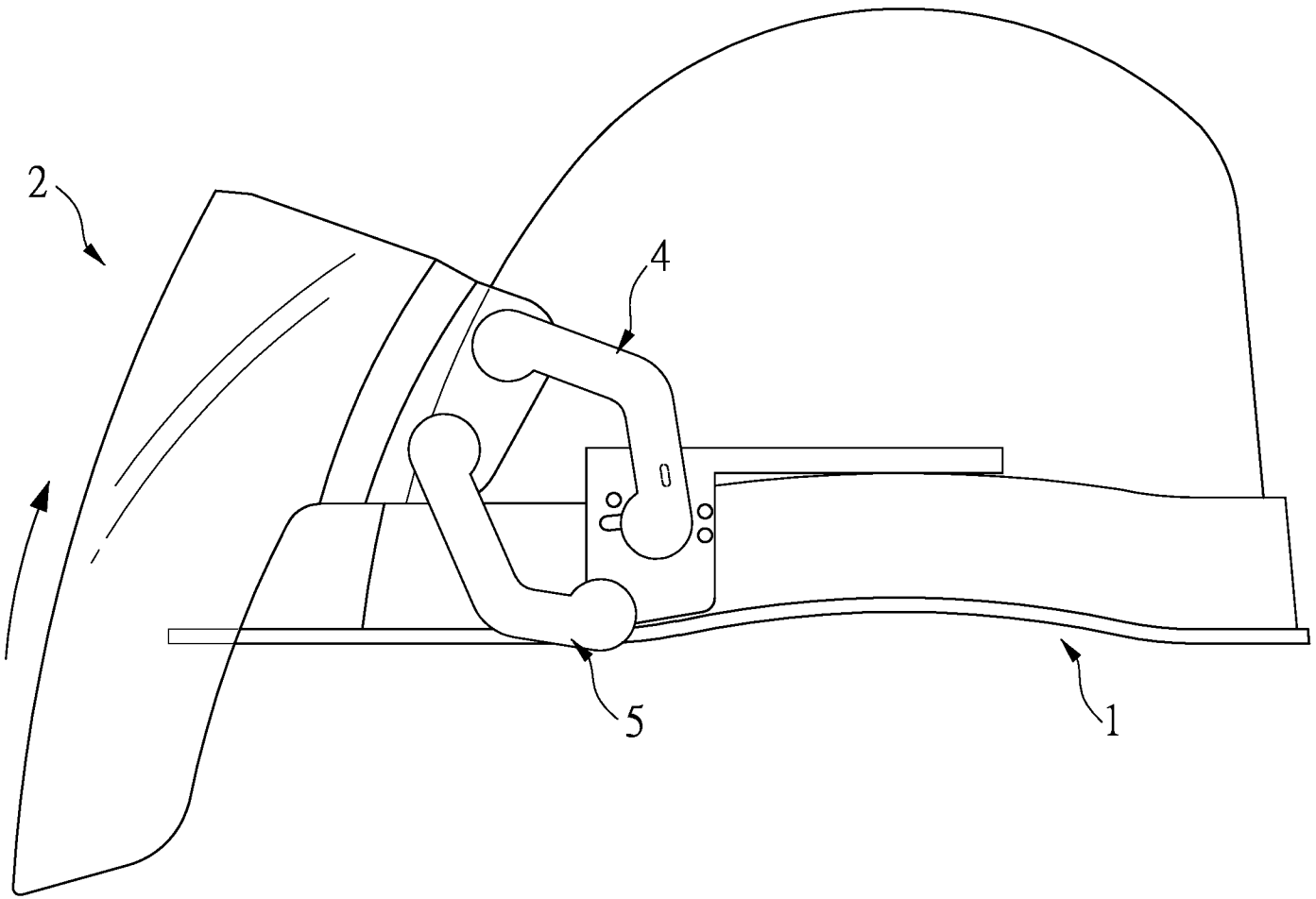
FIG. 4 shows that the protective shield begins to be pivoted to its folded position.
Figure 5:
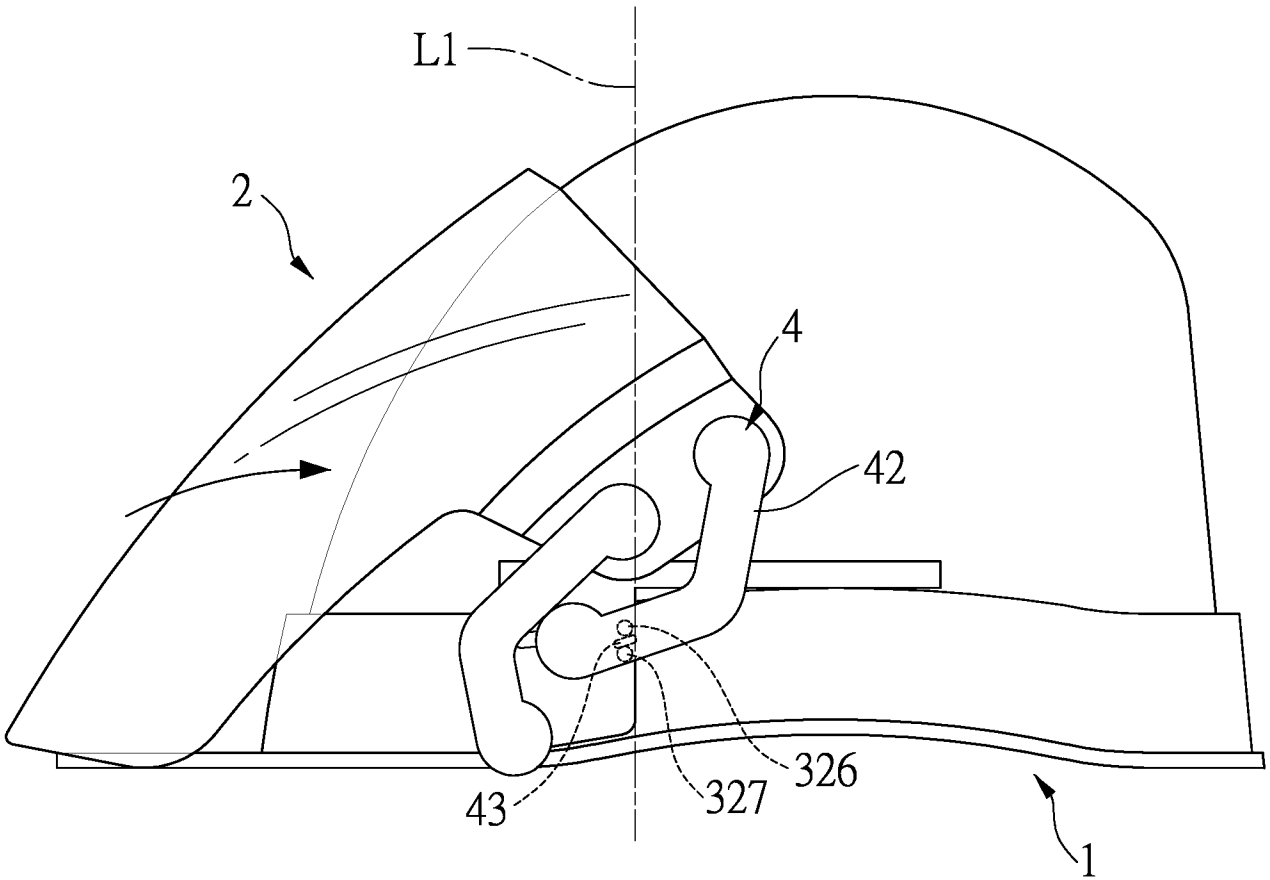
FIG. 5 shows that the protective shield is pivoted to its folded position, the second section of each first arm is located between the imaginary line and the connection portion.

The protective shield 2 can be pivoted downward to its operation position as shown in FIG. 3, or the protective shield 2 can be pivoted upward to its operation position as shown in FIGS. 4 and 5.

As shown in FIG. 5, the second end part 32 of each connector 3 in this embodiment is a rectangular part and includes an outer side and an inner side in the axial direction of the second end part 32, wherein the inner side is located between the connection portion 11 and the outer side. An imaginary line L1 is formed along the inner side. When the protective shield 2 is located at the folded position, the second section 42 of each first arm 1 is located between the imaginary line L1 and the connection portion 11, such that the protective shield 2 is positioned close to the hat 1.

As shown in FIGS. 6 to 9, the second end part 32 of each of the two connectors 3 includes a first ball 321 and a first stop 322 which is located below the first ball 321. Each first arm 4 includes a protrusion 43 extending therefrom which faces the hat 1. When the protective shield 2 is pivoted downward and positioned to the operation position, the protrusion 43 of each first arm 4 is located between the first ball 321 and the first stop 322 of the second end part 32 corresponding thereto. The first stops 322 prevent the first arms 4 from overly pivoted when the protective shield 2 is pivoted to the operation position. The first balls 321 prevent the protective shield 2 from being pivoted upward from the operation position by wind or by shaking of the user's head. The first balls 321 provides a proper resistance when the protrusions 43 roll over the first ball 321. The distance that each first ball 321 protrudes beyond the second end part 32 is less than that of each first stop 322 protruding beyond the second end part 32. The first arms 4 are flexible so that the protrusions 43 are able to roll over the first balls 321.

Specifically, each connector 3 includes a first recess 323 which communicates with a first opening 324 formed to the surface of the second end part 32 of the connector 3 that the first ball 321 and the first stop 322 are located. A first resilient member 325 is located in the first recess 323 of each connector 3 and biased between the inner end of the first recess 323 and the first ball 321 which partially protrudes beyond the first opening 321. In other words, the diameter of the first ball 321 is slightly larger than the diameter of the first opening 324. When the protrusion 43 rolls over the first ball 321, the first ball 321 is retracted by compressing the first resilient member 325. The resistance that the first ball 321 provides when the protrusion 43 rolls over the first ball 321 is decided by the first resilient member 325. This ensures that the protrusions 43 are able to roll over the first balls 321 regardless the flexibility of the first arms 4.

Figure 6:
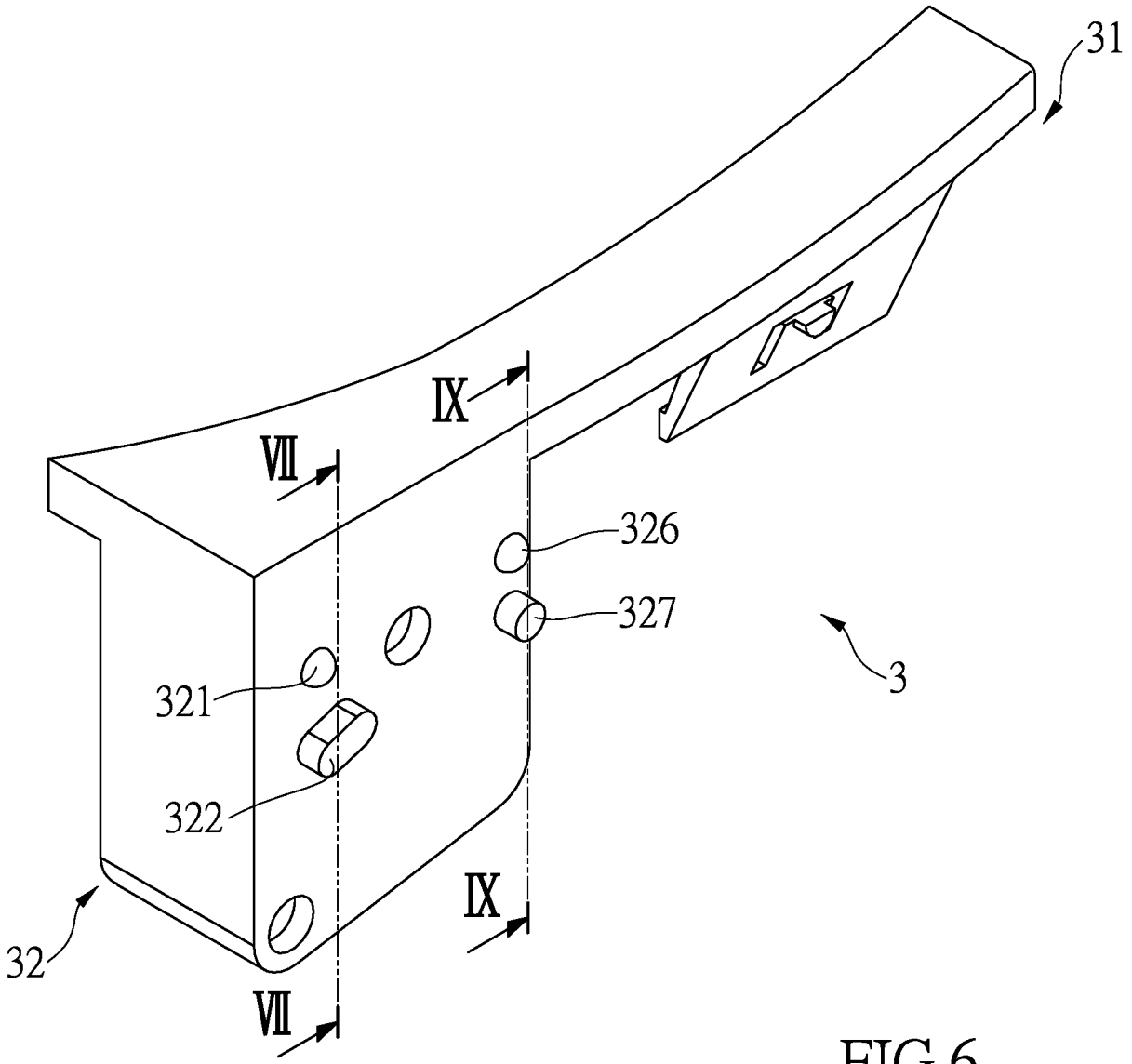
FIG. 6 is a perspective view to show the connector of the headwear of the present invention.
Figure 7:
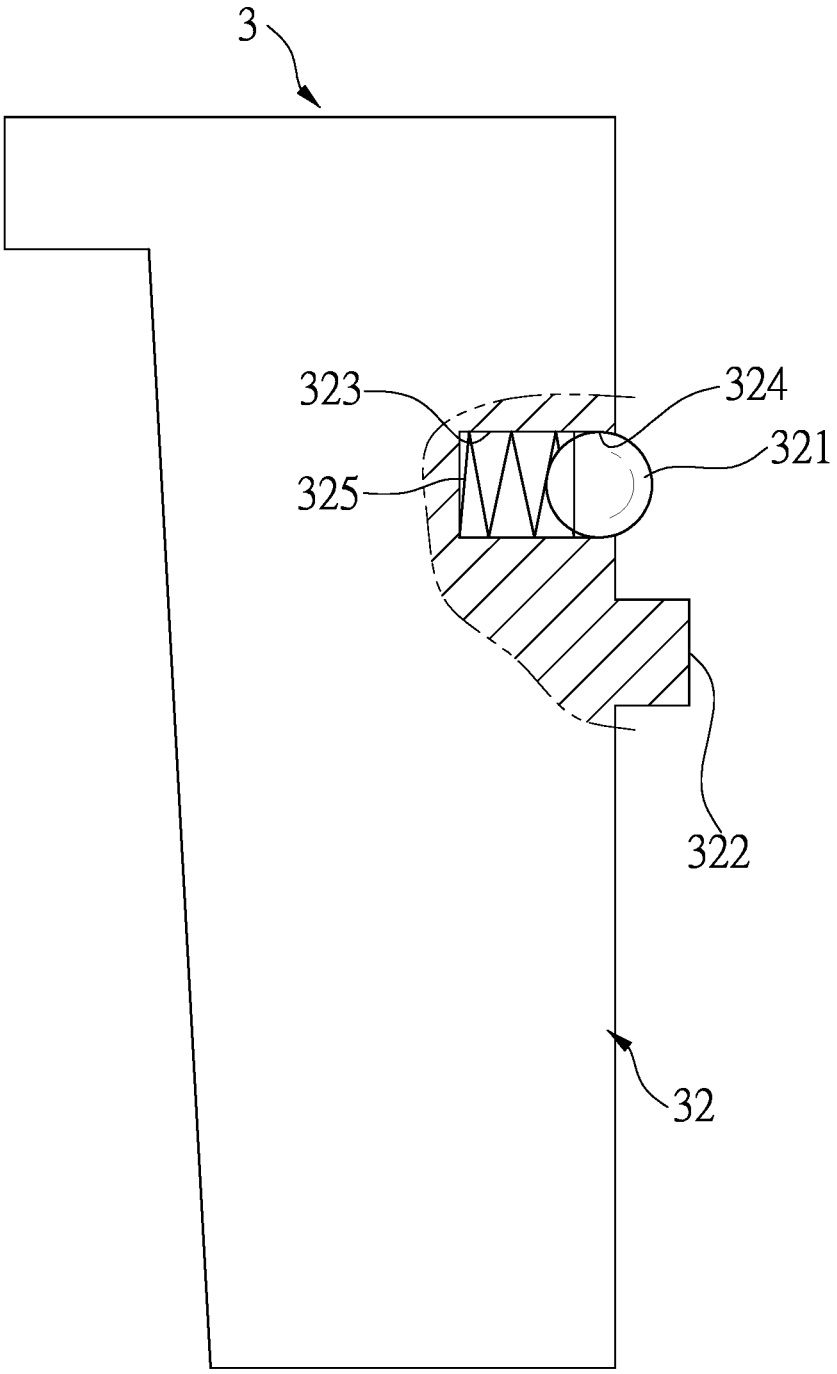
FIG. 7 is a cross sectional view, taken along line VII-VII in FIG. 6.
Figure 8:
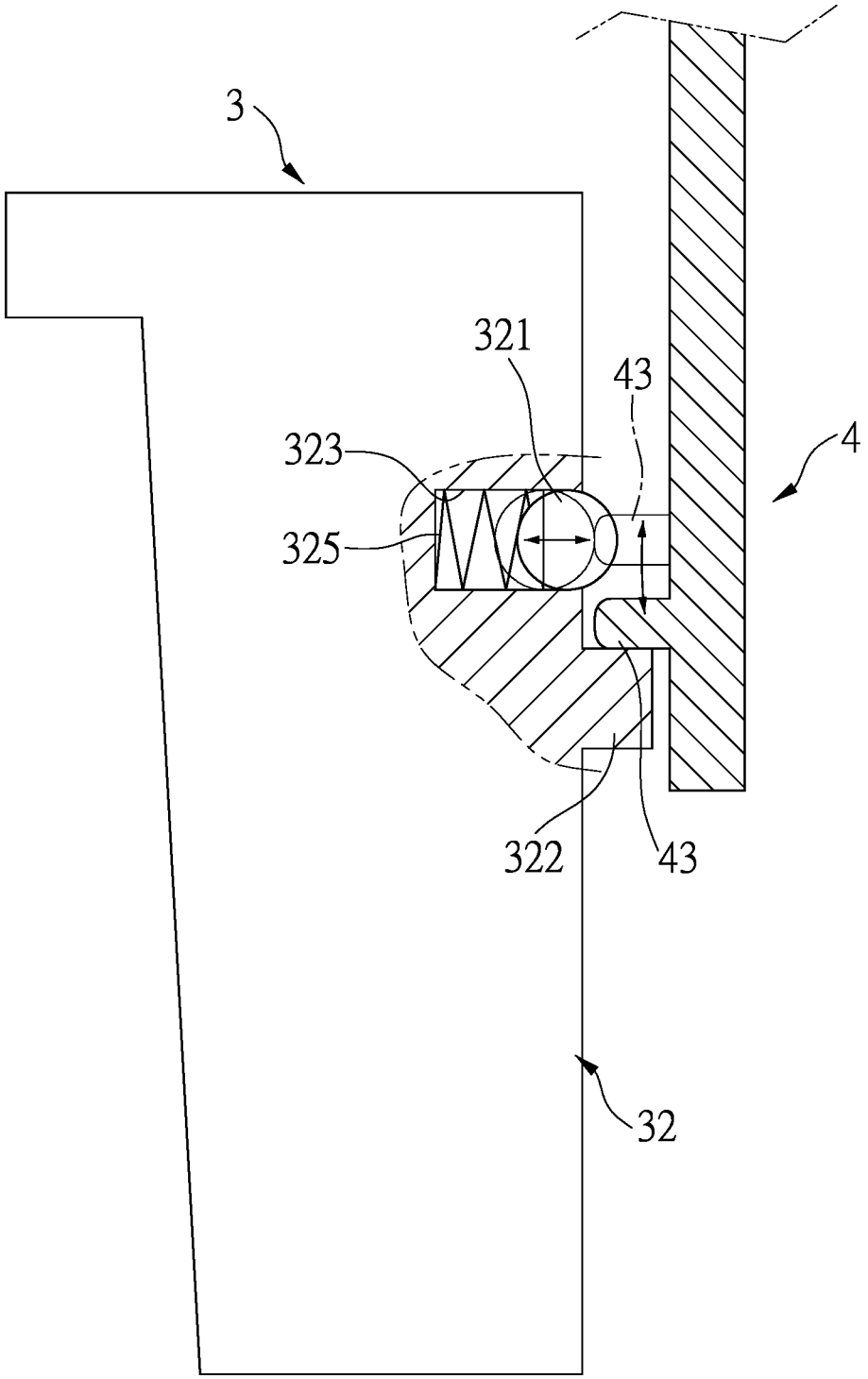
FIG. 8 illustrates the position of the protrusion when the protective shield is pivoted to its operation position.
Figure 9:
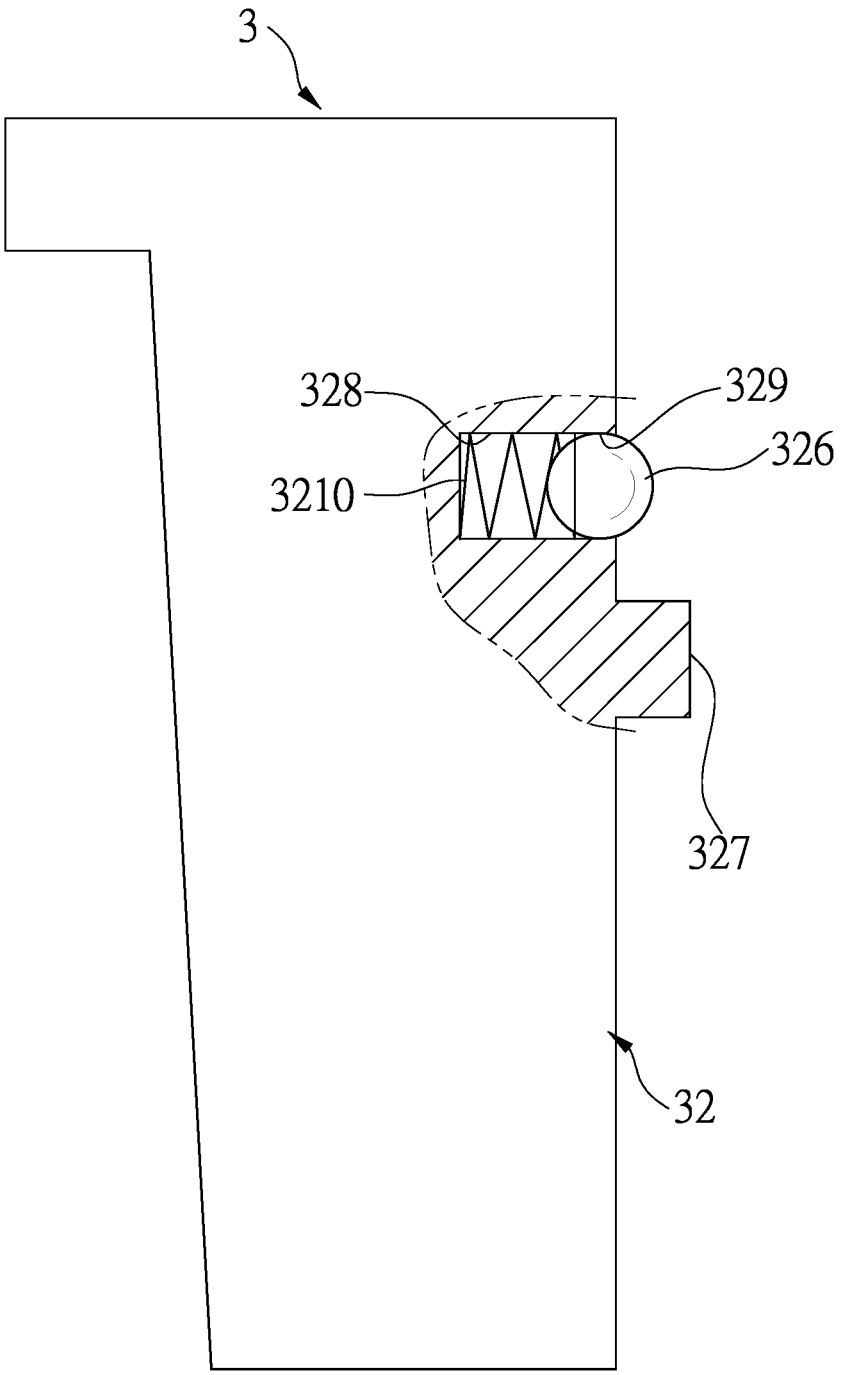
FIG. 9 is a cross sectional view, taken along line IX-IX in FIG. 6.
Figure 10:
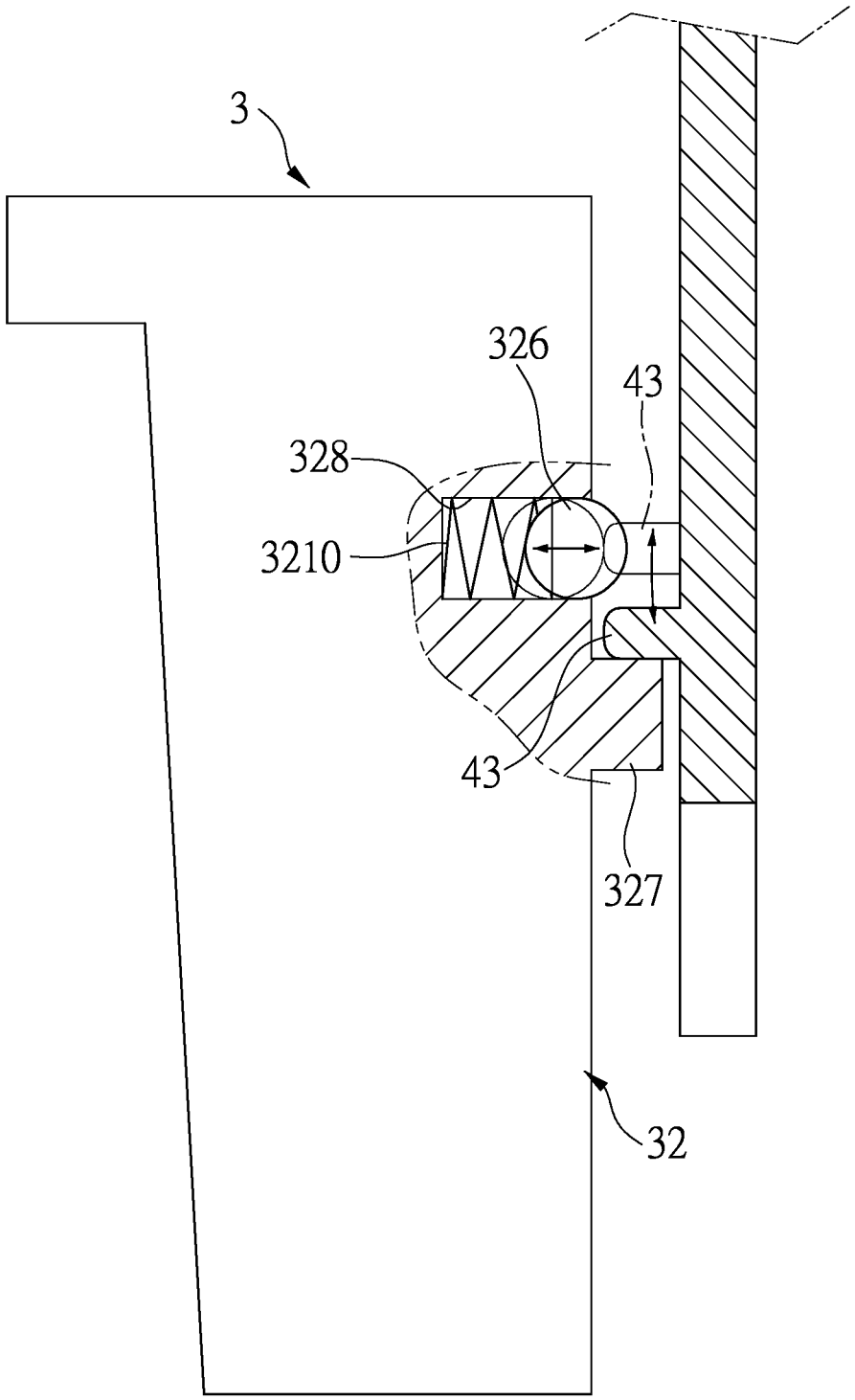
FIG. 10 illustrates the position of the protrusion when the protective shield is pivoted to its folded position.

As shown in FIGS. 6, 9 and 10, the second end part 32 of each connector 3 includes a second ball 326 and a second stop 327. Each first arm 4 includes a protrusion 43 extending therefrom which faces the hat 1. When the protective shield 2 is pivoted upward and positioned to the folded position, the protrusion 43 of each first arm 4 is located between the second ball 326 and the second stop 327 corresponding thereto. Each connector 3 includes a second recess 328 which communicates with a second opening 329 formed to the surface of the second end part 32 of the connector 3 that the second ball 326 and the second stop 327 are located. A second resilient member 3210 is located in the second recess 328 of each connector 3 and biased between the inner end of the second recess 328 and the second ball 326 which partially protrudes beyond the second opening 329. In other words, the diameter of the second ball 326 is slightly larger than the diameter of the second opening 329. The functions of the second balls 326 and the second stops 327 are similar to those of the first balls 321 and the first stops 322. The second stops 327 prevent the first arms 4 from overly pivoted. The second balls 326 prevent the protective shield 2 from pivoted downward from the folded position by a minor force.

Figure 11:
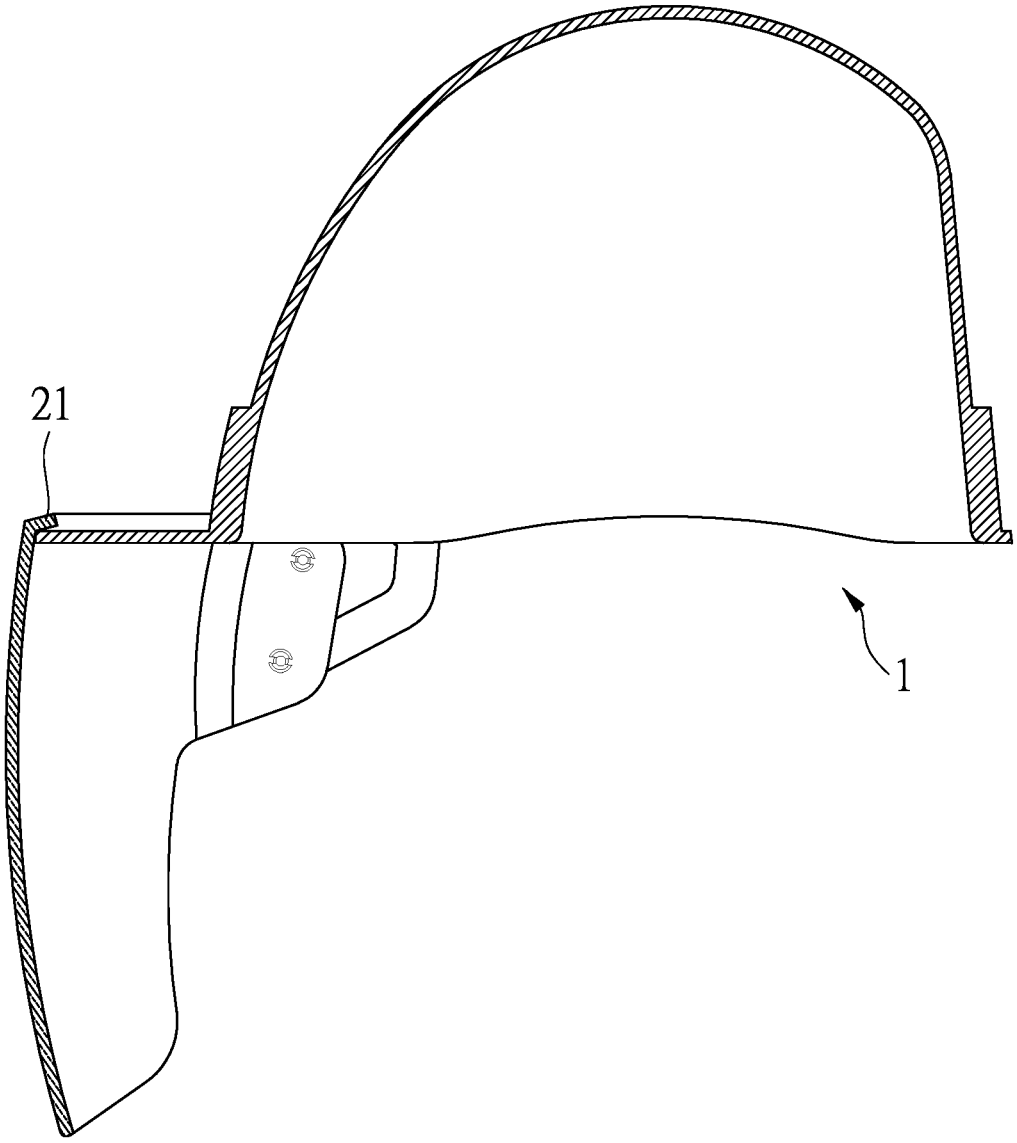
FIG. 11 illustrates that the flange of the protective shield contacts the visor of the hat when the protective shield is pivoted to its operation position.

As shown in FIG. 11, the hat 1 includes a visor 12, and the protective shield 2 includes a flange 21 extending from the top edge thereof. When the protective shield 2 is positioned at the operation position, the protective shield 2 contacts the visor 12 to prevent foreign objects from passing between the protective shield 2 and the visor 12.

While we have shown and described the embodiment in accordance with the present invention, it should be clear to those skilled in the art that further embodiments may be made without departing from the scope of the present invention.

What is claimed is:

1. A headwear comprising:

a hat having two connection portions, each connection portion of the two connection portions formed to two opposite sides of the hat, respectively;

a protective shield;

two connectors each having a first end part and a second end part respectively formed to two ends of the connector, the two respective first end parts of the two connectors respectively connected to the two connection portions of the hat, the second end part of each of the two connectors including a first ball and a first stop which is located below the first ball;

two first arms each having a first section and a second section which is angularly formed to the first section, the two respective first sections respectively and pivotably connected to the two respective second end parts of the two connectors, the two respective second sections respectively and pivotably connected to the protective shield, each first arm of the two first arms including a protrusion extending therefrom which faces the hat, when the protective shield is pivoted downward and positioned to an operation position, the protrusion of each first arm of the two first arms is located between the first ball and the first stop of the second end part, and two second arms each having a third section and a fourth section which is angularly formed to the third section, the two respective third sections respectively and pivotably connected to the two respective second end parts of the two connectors, the two respective fourth sections respectively and pivotably connected to the protective shield.

2. The headwear as claimed in claim 1, wherein each connector of the two connectors includes a first recess which communicates with a first opening formed to a surface of the second end part of the connector, a first resilient member is located in the first recess of each connector of the two connectors and biased between an inner end of the first recess and the first ball which partially protrudes beyond the first opening.

3. The headwear as claimed in claim 2, wherein the second end part of each connector of the two connectors includes a second ball and a second stop, each first arm of the two first arms includes the protrusion extending therefrom which faces the hat, when the protective shield is pivoted upward and positioned to a folded position, the protrusion of each first arm of the two first arms is located between the second ball and the second stop.

4. The headwear as claimed in claim 3, wherein each connector of the two connectors includes a second recess which communicates with a second opening formed to a surface of the second end part of the connector, a second resilient member is located in the second recess of each connector of the two connectors and biased between an inner end of the second recess and the second ball which partially protrudes beyond the second opening.

5. The headwear as claimed in claim 1, wherein the hat includes a visor, the protective shield includes a flange extending from a top edge thereof, when the protective shield is positioned at the operation position, the protective shield contacts the visor.

6. The headwear as claimed in claim 1, wherein the second end part of each connector of the two connectors includes an outer side and an inner side, the inner side is located between the respective connection portion and the outer side, an imaginary line is formed along the inner side, when the protective shield is located at a folded position, the second section of each first arm of the two first arms is located between the imaginary line and the respective connection portion.

* * * * *